US006158852A

United States Patent [19]

Sato et al.

[11] Patent Number: 6,158,852

[45] **Date of Patent: *Dec. 12, 2000**

[54] INK REFILLING METHOD AND APPARATUS FOR INK CARTRIDGE

[75] Inventors: Osamu Sato, Kawasaki; Sadayuki Sugama, Tsukuba, both of Japan

[73] Assignee: Canon Kabushiki Kaisha, Tokyo, Japan

[ * ] Notice: This patent is subject to a terminal disclaimer.

[21] Appl. No.: 09/363,827

[22] Filed: Jul. 30, 1999

Related U.S. Application Data

[62] Division of application No. 08/963,910, Nov. 4, 1997, Pat. No. 6,053,604, which is a continuation of application No. 08/350,104, Nov. 29, 1994, abandoned.

[30] Foreign Application Priority Data

| | | | |
|---|---|---|---|
| Nov. 29, 1993 | [JP] | Japan | 5-298202 |
| Oct. 28, 1994 | [JP] | Japan | 6-265057 |

[51] Int. Cl.[7] ..... B41J 2/175

[52] U.S. Cl. ..... 347/85

[58] Field of Search ..... 347/85–87; 1141/18, 1141/21

[56] References Cited

U.S. PATENT DOCUMENTS

| | | | |
|---|---|---|---|
| 4,931,814 | 6/1990 | Yoshimura | 347/86 |
| 4,968,998 | 11/1990 | Allen | 347/87 |
| 5,126,767 | 6/1992 | Asai | 347/86 |
| 5,155,502 | 10/1992 | Kimura et al. | 347/87 |
| 5,162,817 | 11/1992 | Tajika et al. | 347/86 |
| 5,280,299 | 1/1994 | Saikawa et al. | 347/87 |
| 5,510,820 | 4/1996 | Aulick et al. | 347/85 |
| 5,790,157 | 8/1998 | Higuma et al. | 347/85 |

FOREIGN PATENT DOCUMENTS

| | | | |
|---|---|---|---|
| 536980 | 4/1993 | European Pat. Off. . | |
| 567308 | 10/1993 | European Pat. Off. . | |
| 611656 | 8/1994 | European Pat. Off. . | |
| 3401071 | 7/1985 | Germany . | |
| 5-104735 | 4/1993 | Japan | 347/86 |
| 92/20577 | 11/1992 | WIPO . | |
| 93/18920 | 9/1993 | WIPO . | |

*Primary Examiner*—N. Le
*Assistant Examiner*—Judy Nguyen
*Attorney, Agent, or Firm*—Fitzpatrick, Cella, Harper & Scinto

[57] ABSTRACT

An ink refilling method for refilling the ink into an ink cartridge comprising an ink guiding member and an ink absorbing member, includes the following steps of preparing an ink refilling apparatus for refilling the ink into the ink absorbing member disposed within the ink storing portion of the ink cartridge, through an ink guiding member, wherein an ink refilling apparatus includes a refill ink storing portion for storing the refill ink; an air ventilating portion for allowing communication between the refill ink storing portion and the atmospheric air; a sealing member for sealing the air ventilating portion; an ink injecting portion to be inserted into the ink delivery port portion of the ink cartridge; an opening portion for guiding the ink out of the refill ink storing portion, being provided on the ink injecting portion; and a pressure generating device for increasing the internal pressure of the refill ink storing portion; inserting the ink injecting portion of the ink refilling apparatus into the ink delivery port portion of the ink cartridge; breaking the meniscus formed at the opening portion of the ink refilling apparatus with the use of the pressure generating device, so that the ink within the refill ink storing portion of the ink refilling apparatus is guided toward the ink guiding material of the ink cartridge; and removing the sealing member covering the air ventilation portion, so that the ink can naturally descend into the ink storing portion of the ink cartridge.

2 Claims, 7 Drawing Sheets

INK REFILLING METHOD AND APPARATUS FOR INK CARTRIDGE

This application is a division of U.S. application Ser. No. 08/963,910, filed Nov. 4, 1997, now U.S. Pat. No. 6,053, 604, which is a continuation of application Ser. No. 08/350, 104, filed Nov. 29, 1994, abandoned.

FIELD OF THE INVENTION AND RELATED ART

The present invention relates to an ink refilling method and an ink refilling apparatus, in particular, an ink refilling method for refilling the ink into the ink storing portion of an exchangeable ink cartridge that is integrally connected to a recording head when in use, and an ink refilling apparatus that is used in such a method.

As for a recording system employed in a recording apparatus that uses a recording head to record images on recording medium (hereinafter, simply recording paper or paper) such as a sheet of ordinary paper of OHP, there are the wire dot system, thermal system, thermal transfer system, or ink jet system. In the case of the ink jet system, the recording medium and recording head do not make contact during a printing operation, offering such advantages as high speed and low noise; therefore, it is one of the systems that has recently been attracting the most attention.

As for the type of the ink jet type apparatus, there are the thermal energy type that uses the film boiling phenomenon, the type that employs a piezoelectric element, the type that employs optical energy, and so on. In any case, they all form images by ejecting ink droplets onto the recording medium.

The ink jet recording apparatus comprises a recording head for ejecting the ink and an ink container for storing the ink, and has so many different system configurations.

In one of such system configurations, the recording head and ink container are connected to each other with the use of a connecting member such as a piece of tube, and only the ink container is exchanged, allowing the recording head to be semi-permanently used.

As for other system configurations, there are: those in which the recording head and ink container are integrally formed, and when the ink within the ink container is depleted, the ink container and recording head are both disposed; and those in which the recording head and ink container are independent from each other and separably connected to form a head unit, and when the ink within the ink container is depleted, the ink container is separated from the head and exchanged with a fresh one.

In any case, the ink container must be exchanged with a fresh one when the stored ink is depleted. In particular, in the case of the system employing the integral structure, even the recording head must be disposed of together with the ink container, which makes the system extremely uneconomical.

There are also other problems. For example, when an ink refilling apparatus is disposed of, it must be grouped according to its raw material.

On the other hand, in recent years, there have been a few proposals in which the problem of being forced to dispose of the recording head that is still usable when the ink within the ink jet unit is depleted is solved by providing a structure in which the recording head and ink container are easily connected or disconnected.

It is conceivable to refill the ink into the exchangeable ink container of such an ink jet unit, through its opening to which the recording head is connected. However, even when the aforementioned ink refilling apparatus of the bellows type or the like is employed, the problems described previously remain the same. In particular, the problem of the ink leak has been more closely looked at, since the opening of the ink container, at which the ink container is connected to the recording head, is extremely large relative to the needle of a conventional ink refilling apparatus.

SUMMARY OF THE INVENTION

The primary object of the present invention is to provide a combination of an ink refilling apparatus and an ink refilling method, with which ink can be preferably refilled into an exchangeable ink cartridge for an ink jet unit.

After studying carefully the above object, the inventors of the present invention acquired the knowledge that the ink can be preferably refilled by inserting the ink injecting portion of the ink refilling apparatus into an ink delivery port of the ink cartridge, and then, letting the ink descend naturally.

The present invention was made based on the above knowledge, and proposes:

an ink refilling method as a method for refilling the ink into the ink cartridge, comprising the following steps of: preparing an ink refilling apparatus for filling the ink into the ink absorbing member disposed within the ink storing portion of said ink cartridge, through an ink guiding member, wherein an ink refilling apparatus comprises: a refill ink storing portion for storing the refill ink; an air ventilating portion for allowing the communication between the refill ink storing portion and the atmospheric air; a sealing member for sealing the air ventilating portion; an ink injecting portion to be inserted into the ink delivery port portion of the ink cartridge; an opening portion for guiding the ink out of the refill ink storing portion, being provided on the ink injecting portion; and pressure generating means for increasing the internal pressure of the refill ink storing portion; inserting the ink injecting portion of the ink refilling apparatus into the ink delivery port portion of the ink cartridge; breaking the meniscus formed at the opening portion of the ink refilling apparatus with the use of the pressure generating means, so that the ink within the refill ink storing portion of the ink refilling apparatus is guided toward the ink guiding material of the ink cartridge; and removing the sealing member covering the air ventilation portion, so that the ink can naturally descend into the ink storing portion of the ink cartridge.

Another object of the present invention is to provide an ink refilling method comprising the above steps and another step in which the opening portion of the ink refilling apparatus is pressed upon the ink guiding material of the ink cartridge so that the ink guiding material is shifted.

Another object of the present invention is to provide an ink filling apparatus as the ink filling apparatus for filling the ink into the ink cartridge comprising the ink storing portion, comprising: a refill ink storing portion for storing refill ink; an air ventilating portion for allowing the communication between the refill ink storing portion and the atmospheric air; a sealing member for sealing the air ventilating portion; an ink injecting portion to be inserted into the ink delivery port portion of the ink cartridge; an opening for guiding the ink out of the refill ink storing portion, being provided on the ink injecting portion; and pressure generating means for increasing the internal pressure of the refill ink storing portion so that the ink meniscus formed at the opening portion is destroyed.

Another object of the present invention is to provide a structure in which the ink injection portion of the ink refilling apparatus is given such a length that when the ink injecting portion of the ink refilling apparatus is inserted into the ink cartridge, the opening portion of the ink refilling apparatus is pressed upon the ink guiding member of the ink cartridge and shifts it.

According to the present invention, when the ink is refilled with the use of the combination of the above ink refilling method and ink refilling apparatus, the ink is allowed to descend and disperse naturally; therefore, the refilling speed is dependent on the ink absorbing speed of the absorbent material within the ink cartridge. As a result, the ink can be uniformly filled, and also, the ink does not leak out of the joint portion at which the ink delivery port and ink injecting portion of the ink refilling apparatus are connected.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the embodiment of the present invention will be described in detail with reference to the drawings.

Figure 1:
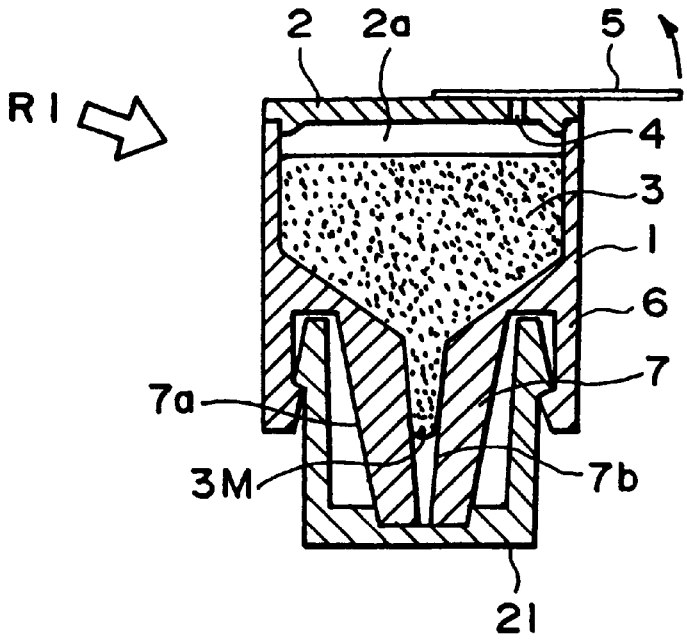
FIG. 1 is a sectional view of an ink refilling apparatus in accordance with the present invention.

FIG. 1 shows an ink refilling apparatus R1 in accordance with the present invention. In the drawing, a reference numeral 1 designates an ink storing portion, and 2 designates a cover for covering the ink storing portion 1. This cover 2 is provided with an air ventilating port 4 for introducing the atmospheric air into the ink storing portion, and a sealing member 5 that seals the air ventilating port 4 when the ink container is not in use such as when the ink cartridge is distributed, and opens it during an ink refilling operation. The cover 2 is melt-welded to the ink storing portion 1 using ultrasonic waves.

The ink storing portion 1 constituting a part of the ink refilling apparatus R1 is made of rigid material, and hardly deforms under an external force. On the contrary, the cover 2 can be flexed by applying an external force so that the internal pressure of the ink storing portion 1 can be increased.

A reference numeral 7 designates an ink injecting tube for injecting the ink 3 within the ink storing portion 1 into an ink cartridge (ink container), which will be described later. The ink injecting tube 7 has a shape like a frustum of a cone, and is provided with a port 7*a*, and an ink passage 7*b* which guides the ink from the ink storing portion to the port 7*a*. The port 7*a* is located on the contact surface located at the tip of the ink injecting tube 7, and ink passage 7*b* runs through the ink injecting tube 7.

A reference numeral 21 designates a cap which seals the port 7*a* to prevent the evaporation of the ink solvent while the cartridge is in storage, and also prevents contamination of the adjacencies of the ink cartridge during distribution; and 6 designates a latching claw which functions to seal the ink injecting tube 7 of the ink refilling apparatus R1 with the cap 21 during the distribution,and latches onto the ink container during the ink refilling operation.

The port 7*a* can properly maintain the ink delivery conditions under which the ink is refilled into the ink container 14, and its diameter is such that when the cap 21 is off but the air ventilating port 4 is still sealed with the sealing member 5, the ink meniscus formed at the opening portion of the ink injecting tube 7 cannot be simply destroyed due to external factors, such as vibration.

With the provision of the above structure, the ink does not easily leak out of the port 7*a* even if the ink refilling apparatus is affected by external factors while it is not in connection with the ink container.

Further, it is preferable that the diameter of the ink passage 7*b* is regulated to allow the formation of the ink meniscus. With the implementation of this regulation, a meniscus 3M forms as shown in FIG. 1 during distribution. In other words, with the presence of air in a region of the ink passage 7*b* adjacent to the port 7*a*, the ink leak can be prevented even when the cap 21 is simply pressed on without being melt-welded or glued to the ink refilling apparatus. Further, even when the internal pressure of the ink refilling apparatus changes after the cap is removed to refill the ink, it is adjusted as the meniscus 3M shifts, which makes it less likely for the ink to leak out of the port 7*a* and contaminate the adjacencies.

Figure 2:
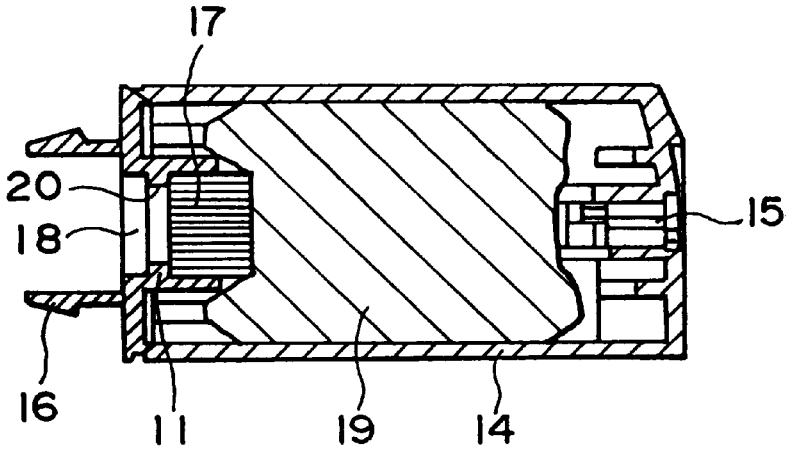
FIG. 2 is a sectional view of a typical ink container to be refilled with the use of the ink refilling apparatus in accordance with the present invention.

Next, FIG. 2 shows an ink container 14 in the most preferable form of a cartridge type ink storing portion (so-called ink cartridge) 14, with which the ink refilling apparatus in accordance with the present invention is usable. In FIG. 2, the ink container 14 contains an ink absorbing member 19 that is a porous member for storing the ink, and an ink guiding member 17 for delivering the ink from the ink absorbing member 19 to an ink supply tube of the recording head. The ink guiding member 17 is disposed so as to face directly an ink delivery port 18. Further, a connecting mechanism 16, which engages with the aforementioned latching claw 6 or an engaging portion provided on the recording head side (unillustrated), is on the external wall of the ink container, that is, the wall where the ink delivery port 18 is located.

The ink delivery port 18 is a portion where the ink delivery tube provided on the recording head is connected when the ink container 14 is connected to the recording head (unillustrated), and the ink guiding member 17 is constituted of a fiber bundle in which fiber is aligned in the direction parallel to the ink flow so that the ink flow is induced so as to flow the ink from the ink absorbing member 19 toward the ink delivery port 18. This ink guiding member 17 is supported by the guide 11, being pressured toward the ink delivery port 18 by the ink absorbing member 19, and its sliding movement is regulated by a rib 20. A reference numeral 15 designates an air ventilating portion that has an air ventilating port for introducing the atmospheric air into the ink container. In this embodiment, the wall portion where the ink delivery port 18 is located and the wall portion where the air ventilating portion is located are on the opposite sides of the ink container.

Hereinafter, a state in which the aforementioned ink refilling apparatus R1 and ink container 14 are in connection with each other will be described, with reference to the drawings.

Embodiment 1

Figure 3:
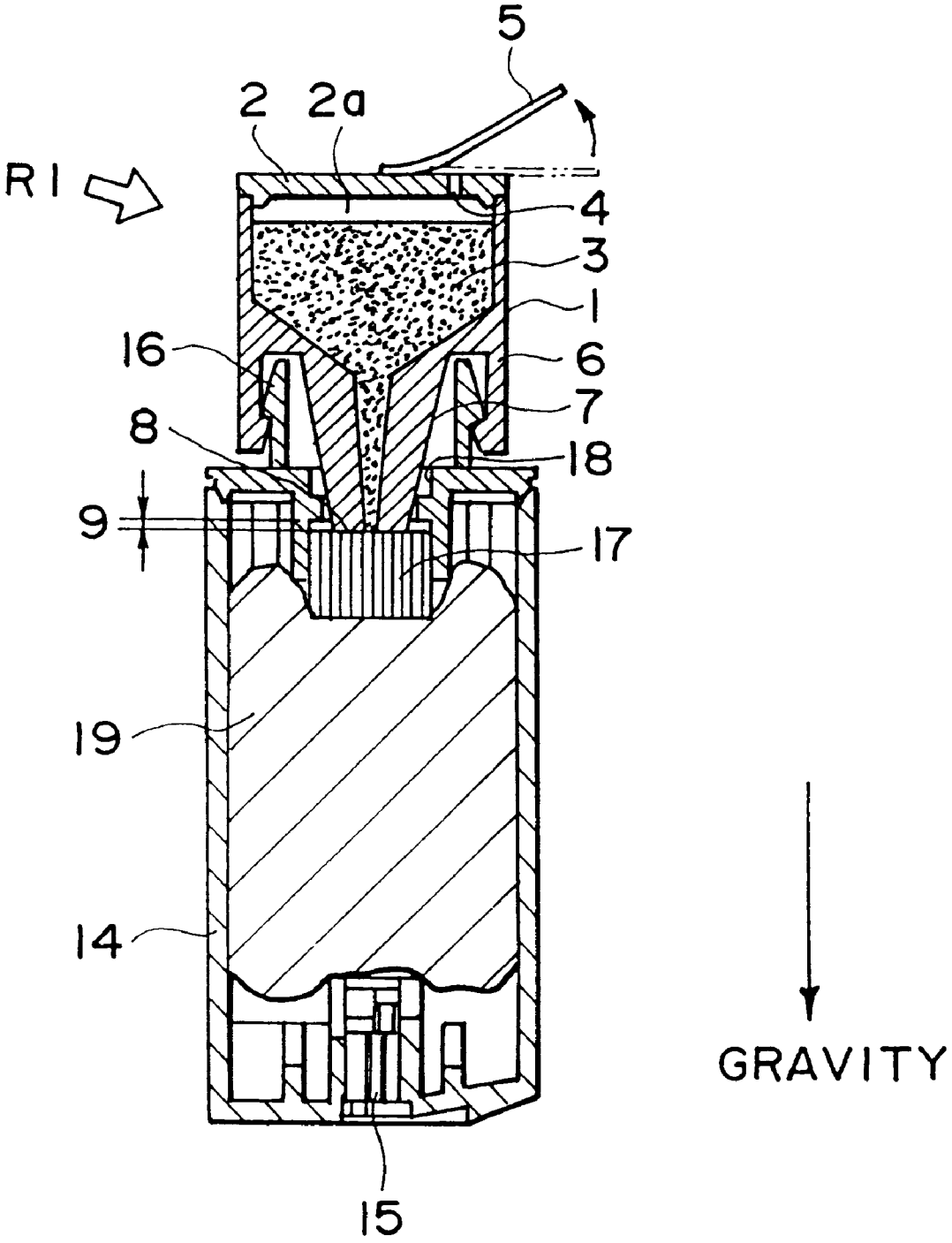
FIG. 3 is a sectional view, depicting a typical manner in which the ink refilling apparatus in accordance with the present invention is connected to the ink container.
Figure 4A:
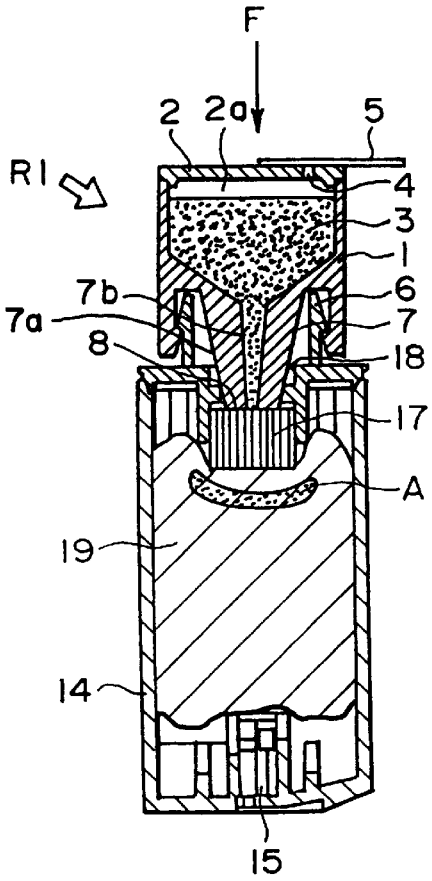
FIGS. 4*a, b, c* and *d* are schematic views for describing the steps through which the ink is refilled using the ink refilling apparatus in accordance with the present invention.
Figure 4B:
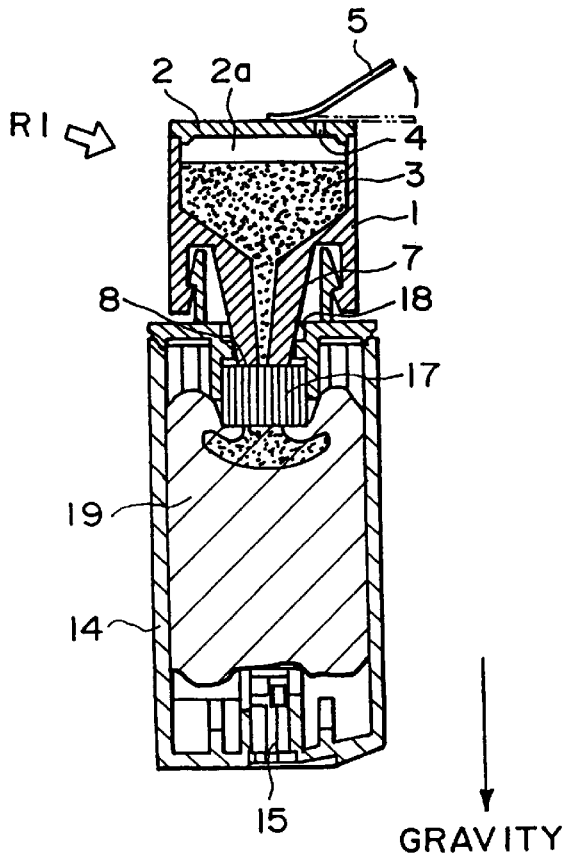
Figure 4C:
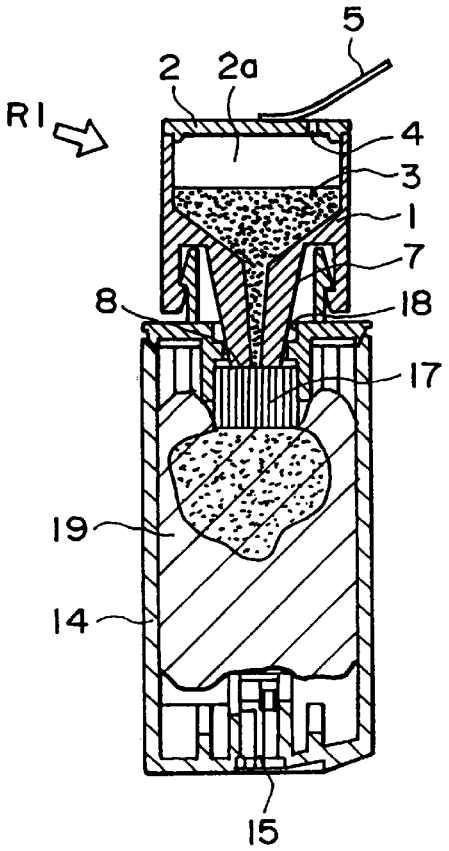
Figure 4D:
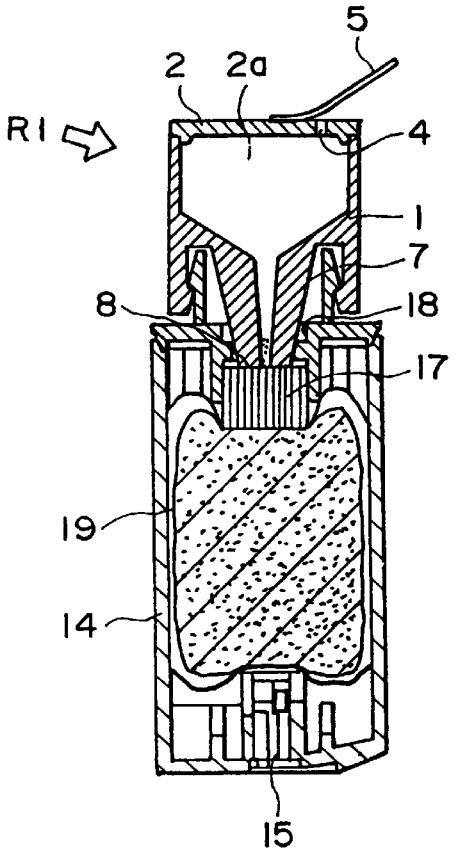

FIG. 3 is a schematic sectional view of a first embodiment of the present invention, illustrating the state of connection between the ink refilling apparatus and ink container. As shown in FIG. 3, the ink refilling apparatus R1 and ink container 14 are connected in such a manner that the ink refilling apparatus R1 is placed above and the ink container 14 is placed below, relative to the gravity direction, and the ink injecting tube 7 of the ink refilling apparatus R1 is in the ink delivery port 18 of the ink container 14.

In this embodiment, the inclination and height of the ink injecting tube 7 shaped like a frustum of a cone is precisely determined so that just when the ink injecting rube 7 comes in contact with the ink guiding member 17, no part of the conic surface of the ink injecting tube 7 contacts the peripheral surface of the ink delivery port 18, but after the tip portion of the ink injecting tube is pressed into the ink guiding member by a predetermined distance, the external diameter of the ink injecting tube 7 near the port 7*a* comes to match substantially the internal diameter of the ink delivery port 18.

In other words, the ink injecting tube 7 is given such a length that not only can it reach in from the outward side periphery of the ink delivery port 18 and touch the outward facing contact surface of the ink guiding member 17, but it also can compress the ink guiding member 17 toward the ink absorbing member 19 by a predetermined margin 9. When the ink is filled using the ink refilling apparatus R1, the ink guiding member 17 is shifted toward the ink absorbing member 19 by the inserted ink injecting tube 7, and is placed in contact with both the ink injecting tube 7 and ink absorbing member 19.

With the employment of the above structure, the ink inflow passage for refilling the ink can be reliably formed even when the ink refilling apparatus and ink container are not airtightly connected during the ink refilling operation; therefore, the manufacturing related restrictions imposed on the ink refilling apparatus can be eased, which in turn makes the production easier.

The relation between the dimensions of the ink injecting tube 7 and ink delivery port 18, and also, the relation between the lengths of the connecting mechanism 16 and latching claw 6 are essential to secure a proper amount of the pressing margin 9, and their dimensions are regulated so as to secure the proper amount of the pressing margin 9.

It is preferable that the measurement of this pressing margin 9 is no more than the amount of distance by which the ink guiding member 17 is shifted as the ink injecting tube is pressed thereon, but is long enough to allow the ink inflow passage to be easily formed without carrying out a large scale recovery by-sucking operation or the like when the recording head is installed after the ink is refilled.

With the employment of the above structure, during the ink refilling operation, the connecting mechanism 16 of the ink container 14 engages with the latching claw 6 of the ink refilling apparatus R1, whereby not only the ink refilling apparatus R1 is fixed to the ink container 14, but also, the ink refilling apparatus, ink guiding member, and ink absorbing member are pressed together substantially in the same manner as when the ink container 14 is connected to the recording head. Therefore, when the ink container 14 is connected to the recording head after the ink is refilled, the ink does not leak out of the ink delivery port portion 18.

Next, the ink refilling steps will be described with reference to FIG. 4.

First, the cap 21 of the ink refilling apparatus R1 is removed. Then, the ink injecting tube 7 is inserted into the ink delivery port 18 of the ink depleted ink container 14 as far as the connecting mechanism 16 of the ink container 14 engages with the latching claw 6 of the ink refilling apparatus R1, as shown in FIG. 4(*a*). In this state, the tip of the ink injecting tube 7 is in contact with the outward facing surface (contact portion 8) of the ink guiding member 17 of the ink container 14, with the pressure generated by the predetermined pressing margin 9, and the ink has not begun to be refilled.

Also, at this time the ink container 14 does not have a capacity to deliver the ink to the recording head. This is because it is no longer possible for the ink passage leading to the recording head side to be formed. Even in this case, a certain amount ink frequently remains in a region of the ink absorbing member, which is the region near the ink delivery port and is designated with a referential character A.

Next, a pressure is applied onto the cover 2 of the ink refilling apparatus R1 to flex it as shown by an arrow mark F in FIG. 4(*a*), so that the internal pressure of the ink storing portion 1 is increased. This action causes the ink meniscus having been formed at the tip portion of the ink injecting tube 7 to advance. As the ink reaches the ink delivery port side surface of the ink guiding member 17, the meniscus having been formed in the ink passage is destroyed, whereby the ink connection is established between the ink guiding member 17 and ink refilling apparatus R1 through the ink passage 7*b*.

At this time, the connection between the ink container 14 and ink refilling apparatus R1 is such that the ink container 14 is vertically oriented with the ink delivery port facing upward, and the ink refilling apparatus is placed on top of the ink container 14 with the port 7*a* of the ink injecting tube 7 facing downward.

In this embodiment, the ink meniscus 3M within the ink passage 7*b* of the ink injecting tube 7 is advanced by pressing the cover 2, and is destroyed as it makes contact with the ink guiding member 17, so that the ink can be refilled. In case the ink guiding member 17 is constituted of a fiber bundle as it is in this embodiment, it may be so structured that, during the operation to connect the ink refilling apparatus to the ink container, the cover 2 is pressed down so that the meniscus 3M is positioned at the port 7*a*, where it makes contact with the fiber, being thereby destroyed, as the ink injecting tube 7 is inserted.

Further, when it is arranged so that the ink head is positioned right next to the port portion of the ink injecting tube 7, the meniscus can be easily destroyed just by pressing the ink injecting tube 7 onto the ink guiding member 17, without applying any other external force, even if the ink guiding member 17 is not constituted of the fiber bundle.

Next, the sealing member 5 sealing the air ventilating port 4 of the cover 2 is removed to relieve the internal space of the ink storing portion 1 to the atmosphere, as shown in FIG. 4(*b*).

This action allows the external air to be introduced into the ink storing portion through the air ventilating port 4, enabling the ink within the ink refilling apparatus R1 to descent naturally due to the gravity, and thus, initiating the ink refilling. Then, the ink is drawn into the ink absorbing member 19 as it naturally falls due to the gravity, and makes connection to the ink having remained in the ink absorbing member.

When, at this time, the strength of the ink meniscus formed within the ink injecting tube 7 cancels the atmospheric pressure and prevents the ink from flowing down, the ink refilling may be initiated by pressing the cover 2 with a finger or the like in a manner to seal the air ventilating port 4, without resealing the air ventilating port 4 with the sealing member.

Then, the ink permeates downward, that is, in the gravity direction, through the ink absorbing member 19, as will as sideways, as shown in FIG. 4(*c*). At this stage, the interior of the ink guiding member 17 serves just as the ink flow passage, allowing the ink to be filled by the ink retaining capability of the ink absorbing member and the gravity.

Lastly, referring to FIG. 4(*d*), as the ink sufficiently permeates in the region of the ink absorbing member below the ink guiding member, it is filled into the region above the ink guiding member by the capillary force of the ink absorbing member, completing the last of the ink refilling steps.

Embodiment 2

Figure 5:
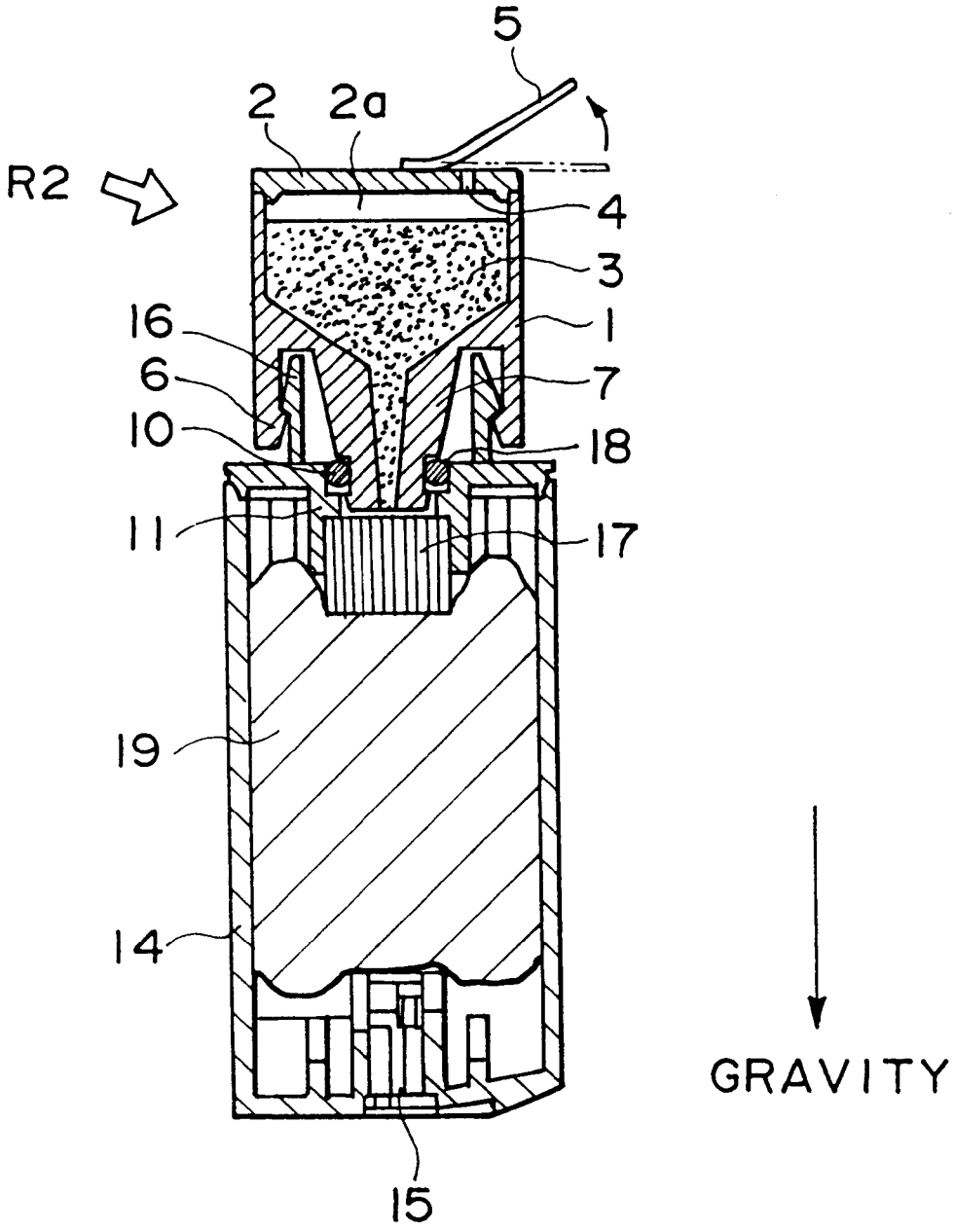
FIG. 5 is a sectional view, depicting a typical manner in which the ink refilling apparatus in accordance with present invention is connected to the ink container.

FIG. 5 is a sectional view of the second embodiment of the present invention. In FIG. 5, the ink injecting tube 7 of this embodiment is provided with an O-ring. This embodiment is different from the preceding one in that the joint between the ink injecting tube 7 and ink delivery port is airtightly sealed with this O-ring 10. The employment of this structure makes it possible to seal more reliably the joint between the ink injecting tube 7 and ink delivery port, preventing thereby more reliably the ink from leaking out of the joint portion during the ink refilling operation.

Needless to say, the joint may be sealed to the same degree of airtightness with the modification, that is, without increase in the component counts, of the external surface configuration of the ink injecting tube such that it conforms to the internal surface configuration of the ink delivery port and creates a state of line contact between the ink delivery port and ink injecting tube, instead of the provision of the O-ring. In such a case, it is preferable that a relatively soft and elastic material is chosen as the material for the ink refilling apparatus.

Figure 6:
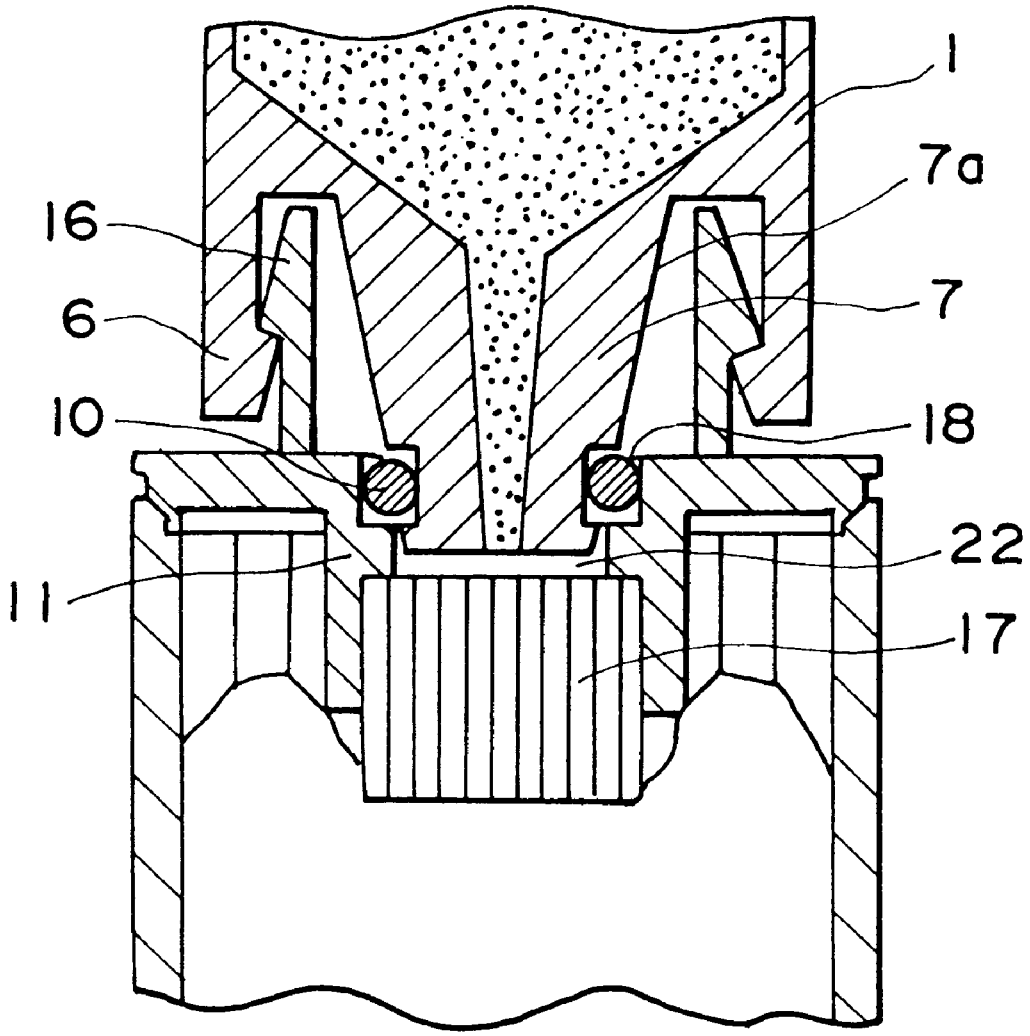
FIG. 6 is an enlarged sectional view of a joint portion between the ink refilling apparatus and ink container illustrated in FIG. 5.

FIG. 6 is an enlarged schematic view of the ink delivery port and its adjacencies during the ink refilling operation carried out according to the preceding embodiment. In FIG. 6, a space designated by a reference numeral 22 is formed by the ink delivery port 18 side facing surface of the ink guiding member 17, port 7*a*-equipped surface of the ink injecting tube, guide portion 11, and O-ring, and this space 22 is filed with the ink during the ink refilling operation. With this arrangement, in contrast to the preceding embodiment in which the ink is filled with the port 7*a* being in contact with the ink guiding member 17, the ink flow passage is evenly formed substantially throughout the ink guiding member, increasing the effective cross-sectional area of the ink flow passage; therefore, the ink refilling speed increases.

It should be noted here that the ink refilling method in accordance with the present invention, which is dependent on the natural descent of the ink, fills the ink at a speed equivalent to the ink absorbing speed of the ink absorbing member 19 or ink guiding member 17.

Since the speed at which the ink naturally descends is caused to conform to the speed at which the ink is absorbed, by pressing the ink injecting tube and ink delivery port, by pressing the ink injecting tube onto the ink guiding member, or by combining the preceding two methods, the ink is not filled faster than it is absorbed; therefore, the liability of ink leak is effectively eliminated.

Further, the system according to the present invention is not of a type in which the lead is forcefully applied; therefore, the ink can be substantially uniformly distributed throughout the ink absorbing member 19. Also, it does not require a user to carry out a complicated ink refilling steps; therefore, the inconvenience taxed on the user is reduced.

The ink absorbing speed of the ink absorbing member 19 or ink guiding member 17 is generally 40 sec/cc or faster, though it is dependent on how dry these components are. Therefore, the internal surface configuration of the ink injecting tube may be modified and/or its internal surface may be treated, so that the speed, at which the ink flows out, exceeds the speed of 40 sec/cc, which is needless to say.

The ink refilling method in accordance with the present invention is a method in which the ink is injected by allowing the ink to descend naturally. The principle thereof will be described below.

Firstly, polyether-urethane foam or the like is employed as the material for the ink absorbing member 19 placed in the ink container 14, and when the ink is injected into this type of material for the first time, it must be forcefully wetted with the ink by reducing the pressure, squeezing it in the ink, or the like method. However, when the ink is refilled, it has been wetted once with the ink, with the ink dye adhering to the foam surface. Since the dye used-in the ink is of a type that is easily soluble in the ink solvent, the dye adhering to the foam surface is naturally agreeable with the new ink; therefore, the ink can naturally descend as described above.

On the other hand, when the old ink adhering to the ink absorbing member 19 had dried up and impedes the ink from descending naturally to be refilled, the cover 2 of the ink refilling apparatus R1 may be pressed as described previously so that the internal air pressure of a pressure generating chamber 2*a* is increased to initiate the ink injection.

Further, it is preferred that the ink absorbing member 19 is compressed into the ink container 14. This is to be done to use the negative pressure, which increases as the ink consumption continues, for dispersing the ink in the ink absorbing member during the ink refilling operation, so that the time it takes to refill the ink can be shortened.

In all of the preceding embodiments, the ink is refilled into the ink container after it becomes impossible for the ink container to deliver the ink to the recording head. However, the ink can be refilled even when the ink remains in the region of the ink absorbing member near the ink guiding member 17 and in the ink guiding member 17 itself, and forms the meniscus at the ink delivery port side surface of the ink guiding member.

In this case, since the ink is present at the end surface of the ink guiding member, the ink from the ink refilling apparatus and the ink within the ink guiding member easily connected to each other. Further, since the ink is not forcefully injected, but is allowed to descent naturally in compliance with the ink retaining capability of the ink absorbing member, the meniscus is formed within the porous material and prevents the ink overfill; therefore, the ink leak or the like problem does not occur when the ink refilling apparatus is removed from the ink container after a predetermined length of time, as long as the air ventilating port 4 is sealed before the removal.

Figure 7:
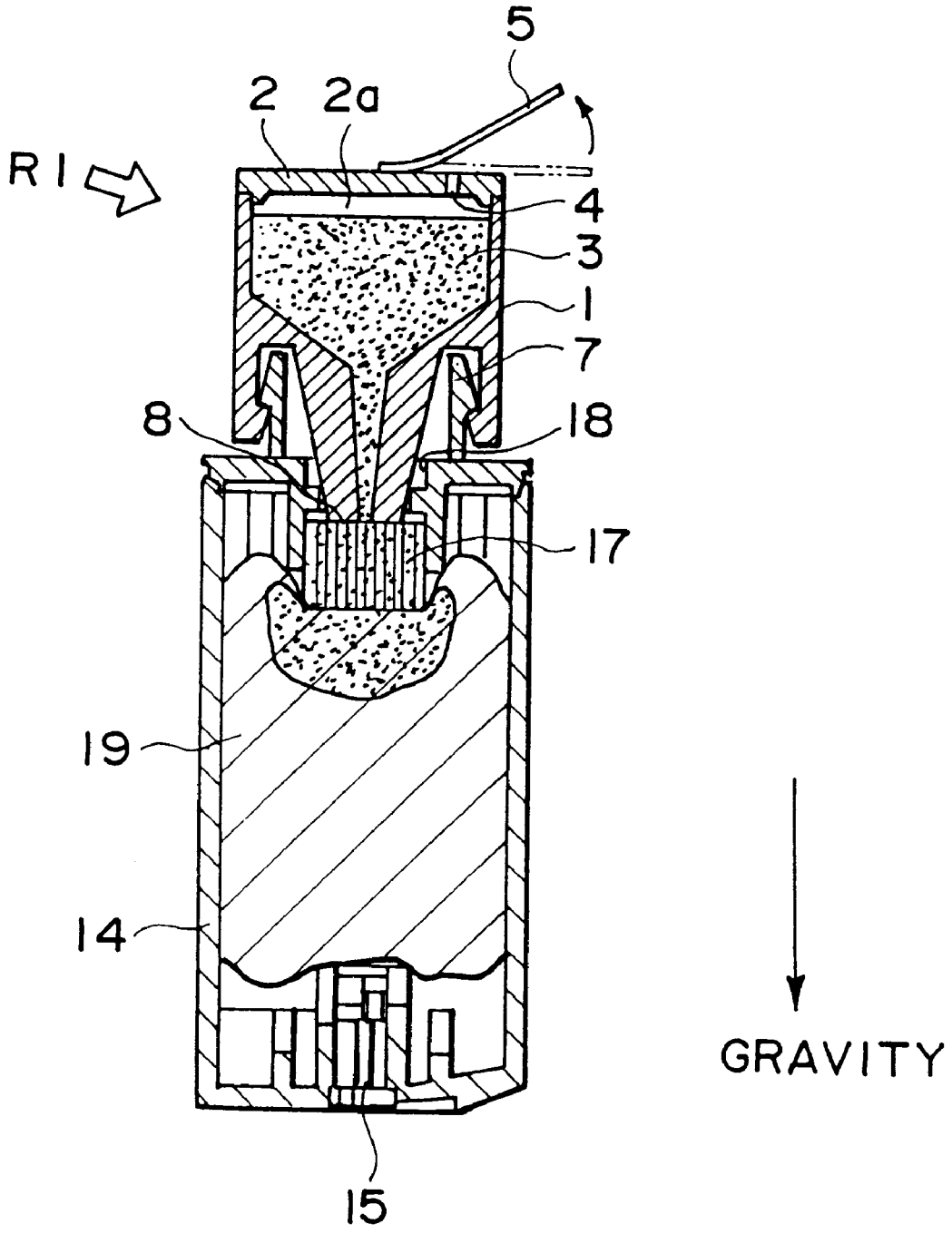
FIG. 7 is a sectional view of a typical ink distribution within the ink container when the ink is refilled using the ink refilling apparatus in accordance with the present invention.

FIG. 7 illustrates a case in which the ink filling method according to the first embodiment is adopted, but the ink filling method according to the second embodiment may be employed. However, when the ink meniscus is formed at the ink delivery port side surface of the ink guiding member, the employment of such a structure as illustrated in FIG. 6, in which the space 22 is present, causes the air within the space 22 to enter the ink guiding member when the ink refilling apparatus is attached, and as a result, there is a chance that applying the pressure once to the ink refilling apparatus may not be enough to establish the ink connection between the ink refilling apparatus and ink guiding member. In such a case, the structure in accordance with the first embodiment is more preferable.

As is evident from the above description, the application of the present invention airtightly connects the ink delivery port of the ink container and the ink injecting portion of the ink refilling apparatus, preventing thereby the ink from leaking out of the joint portion.

Further, the ink injection portion is pressed upon the ink absorbing member of the ink container so that the refilling speed is rendered dependent on the ink absorbing speed of the absorbent material placed within the ink container, therefore, the ink leak is prevented.

Further, the diameter of the ink injecting portion of the ink refilling apparatus is approximately the same as that of the ink delivery port of the ink container; therefore, there is little liability of hurting the human body.

Further, when the ink is refilled, the ink is allowed to descend naturally after the ink delivery port of the ink container and the ink injecting portion of the ink refilling apparatus are airtightly connected, and then, the air ventilating port of the ink storing portion of the ink refilling apparatus is opened; therefore, the ink refilling speed becomes dependent on the ink absorbing speed of the absorbent material within the ink container, being thereby regulated, which not only eliminates the need for a dedicated structure for controlling the ink overflow and ink refilling speed, but also reduces the time the user is bound by the ink refilling operation.

While the invention has been described with reference to the structures disclosed herein, it is not confined to the details set forth and this application is intended to cover such modifications or changes as may come within the purposes of the improvements or the scope of the following claims.

What is claimed is:

1. An ink filling method for filling ink into an ink cartridge having an ink absorbing member capable of providing capillary force, said ink cartridge further having an ink supply outlet portion for supplying ink to a recording head detachably mountable to the ink cartridge and an ink guiding member adjacent said ink absorbing member, said ink guiding member providing a higher capillary force than said ink absorbing member, and an air vent portion away from said ink supply outlet portion, the method comprising the step of:

filling ink into said ink absorbing member of the ink cartridge through the ink guiding member, while said air vent portion is kept open to atmospheric air.

2. An ink refilling method for refilling ink into an ink cartridge having an ink absorbing member capable of providing capillary force, wherein at least a part of ink retained by the ink absorbing member has been consumed, said ink cartridge further having an ink supply outlet portion for supplying ink to a recording head detachably mountable to the ink cartridge, and an air vent portion at a position away from said ink supply outlet portion, the method comprising the steps of:

preparing an ink refilling apparatus having an ink injection portion for refilling the ink into the absorbing member of said ink cartridge, said ink injection portion including an opening;

connecting said ink injection portion of said ink refilling apparatus with the ink supply outlet portion of the ink cartridge;

breaking a meniscus formed at said opening of said ink injection portion; and refilling ink from said refilling apparatus by capillary force of the ink absorbing member into the ink absorbing member of the ink cartridge through the ink supply outlet portion, while said air vent portion is kept open to atmospheric air, and while said ink injection portion of said ink refilling apparatus is press-contacted to the ink absorbing member of said ink cartridge.

* * * * *